US005830034A

United States Patent [19]

Ciechanowski et al.

[11] Patent Number: 5,830,034

[45] Date of Patent: Nov. 3, 1998

[54] PHOSPHORESCENT AMUSEMENT DEVICE

[75] Inventors: Janet M. Ciechanowski; Edward D. Ciechanowski; Robert M. Waldron, all of Portland, Oreg.

[73] Assignee: Lasting Luminous, Inc., Bonney Lake, Wash.

[21] Appl. No.: 783,677

[22] Filed: Jan. 15, 1997

[51] Int. Cl.[6] ..... A63H 33/22; F21V 9/16

[52] U.S. Cl. ..... 446/219; 446/485; 473/570; 362/84; 362/806; 362/186

[58] Field of Search ..... 446/219, 485; 473/594, 570; 362/84, 806, 808, 811, 318, 357, 124, 186

[56] References Cited

U.S. PATENT DOCUMENTS

| | | | |
|---|---|---|---|
| 2,568,279 | 9/1951 | Franz et al. . | |
| 2,644,890 | 4/1953 | Hollihan . | |
| 4,927,015 | 5/1990 | Jones . | |
| 4,963,117 | 10/1990 | Gualdoni | 446/219 |
| 5,007,647 | 4/1991 | Gulick . | |
| 5,228,697 | 7/1993 | Gulick et al. . | |
| 5,330,195 | 7/1994 | Gulick . | |
| 5,417,438 | 5/1995 | Poff . | |
| 5,465,975 | 11/1995 | Shull et al. . | |
| 5,489,241 | 2/1996 | Perrier . | |
| 5,529,541 | 6/1996 | Perrier . | |
| 5,607,621 | 3/1997 | Ishihara et al. | 252/301.36 |

*Primary Examiner*—Robert A. Hafer
*Assistant Examiner*—Laura Fossum
*Attorney, Agent, or Firm*—Kolisch, Hartwell, Dickinson, McCormack & Heuser

[57] ABSTRACT

A glow-in-the-dark article illuminated with phosphorescent filling material and a charging case is described. The article has a pliant outer skin made of light-transmissive fabric on which a light-blocking image is affixed. The skin contains phosphorescent beads or particles. The charging box has an interior cavity with a transparent floor and netting for supporting the glow-in-the-dark article directly above a black light source, thereby effectively suspending the ball free from the sides of the cavity.

16 Claims, 3 Drawing Sheets

Schematic Circuit Diagram

PHOSPHORESCENT AMUSEMENT DEVICE

FIELD OF THE INVENTION

The invention relates to phosphorescent devices. In particular, the invention involves an article with a hidden internal phosphorescing source which is capable of projecting light through an outer translucent skin or screen and a box with a light source for efficiently charging the phosphorescent source through the outer skin.

BACKGROUND OF THE INVENTION

Phosphorescent amusement devices including so-called "glow-in-the-dark" toys have been popular for a long time. Many different interesting glow-in-the-dark effects can be achieved by incorporating phosphorescent chemicals into a myriad of different toy configurations. For example, U.S. Pat. No. 2,644,890 to Hollihan discloses amusement devices, each of which consists of a sealed envelope containing phosphorescent particles visible from outside the envelope. The envelopes take the form of a baby rattle, ball, hourglass, cocktail stirrer, etc. The envelope is hermetically sealed to contain gases such as hydrogen sulfide to stabilize the phosphorescent material. However, Hollihan's teaching that the envelope should be sealed suggests that it is not desirable to use an envelope material which is breathable, and that Hollihan's phosphorescent particles are inherently unstable in ambient conditions. The sealing requirement adds to manufacturing complexity and cost. Further, inclusion of potentially harmful gas compositions within the gas envelope raises safety concerns in the event the seal is ever breached.

One of the limitations with using phosphorescent material as an illumination source is that the intensity and longevity of the light is insufficient compared to other potential light sources. Therefore, other illumination sources have been tried. For example, U.S. Pat. No. 4,963,117 to Gualdoni discloses a ball which contains beads and has an aperture through which a chemical light stick may be inserted. The background of Gualdoni's patent describes numerous attempts by others to provide internal illumination for a ball. However, the devices described by Gualdoni are undesirably cumbersome because they require accessories such as batteries, lightsticks, apertures for inserting or removing devices, etc.

Accordingly, there is a need for a simple toy device configuration which has an internal, long lasting, rechargeable illumination source in an enclosure which hides the source from outside viewing while allowing light transmission through the enclosure, with no need to provide access through the enclosure material, and no need to seal the enclosure.

Thus, an object of the present invention is to provide a glow-in-the-dark amusement device which is fun to play with. The device should employ a rechargeable internal illumination source. The illumination source should be stable and containable within a breathable translucent outer skin which is highly light transmissive, while at the same time blocking actual view of the illumination material.

A further object of the invention is to provide a glow-in-the-dark article which employs a hidden illumination source to highlight an opaque image on a piece of light-transmissive woven fabric.

It is also an object of the invention to employ a phosphorescent material which permits substantially uniform charging throughout a mass of filling material without rotation or manipulation of the article. When the phosphorescent material is in the form of a pile of beads or particles, the buried beads should be accessible and chargeable by an external light source without substantial blocking of light by beads on the top of the pile. The phosphorescent material should be in a relatively stable form without a need for special atmospheric conditions, gases or sealing mechanisms.

Still another object of the invention is to provide a glow-in-the-dark toy which can be charged with light so that the intensity and longevity of the toy's glow is maximized. A related goal is to provide a light box designed to efficiently charge a glow-in-the-dark article contained in the box.

SUMMARY OF THE INVENTION

A multi-faceted amusement device, system and method of the present invention satisfies the objects listed above as well as other unstated goals and advantages. The invention generally involves a glow-in-the-dark article with a pliant translucent outer skin containing phosphorescent particles, and a carrying case or box for maximally charging the glow-in-the-dark article with light. The outer skin of the article allows substantial light transmission while hiding the phosphorescent source from view. A light-blocking or opaque image, message or design can be affixed to the skin, and is highlighted by the source when it glows in the dark. The outer skin is preferably a substantially white woven fabric. In one embodiment of the invention the phosphorescent light source is in the form of oblong particles or beads made of plastic such as polyethylene resin mixed or impregnated with phosphorescent compounds.

A box or chamber for housing and charging the glow-in-the-dark article has an opening and a cover or lid hinged to the box so that when it is closed, a substantially light-tight charging chamber is defined. A light source is provided at the bottom of the chamber below a transparent floor which supports the glow-in-the-dark article while it is being charged. A power source, for example, batteries, are also included in the box. The light source preferably emits black light. A reflective material lines inner walls of the chamber for maximizing charging efficiency.

The invention also provides a method of illuminating or displaying an entertaining, highly visible, image in the dark. A light blocking substance in the form of an image is applied to a piece of substantially light transmissive fabric. The fabric is then interposed between a phosphorescent light source facing the back side of the fabric and a charging light source facing the front side of the fabric. The phosphorescent light source is charged by projecting light from the charging light source through the fabric. The image is then highlighted for viewing from the front side of the fabric, by projecting light from the phosphorescent light source through the fabric.

BRIEF DESCRIPTION OF THE FIGURES

FIG. 2A is a side view of the lid and main chamber portions of the case. FIG. 2B is a top view of an open main chamber portion. FIG. 2C is a top view of the lid.

DETAILED DESCRIPTION OF THE INVENTION

A preferred form of the invention involves a phosphorescent tossing ball and an activation box or charging case. The tossing ball is about the size of a handball and has an outer pliable skin made of plural panels. The skin of the ball is light transmissive, i.e., permits light to pass through the skin. However, the skin is translucent in the sense that it blocks view of the phosphorescent filling material. The filling material includes phosphorescent beads or particles, which, when activated by an external light source shining through the skin for a few minutes, causes the outer skin to "glow" for up to several hours. The phosphorescent beads or particles are preferably light transmissive so that beads sitting inside a pile can receive and emit light even though they are covered by other beads. A light-blocking or opaque graphic image, message or design is affixed to the skin so that when the phosphorescent filling material glows in the dark, the image, message or design is brightly highlighted.

Another aspect of the invention relates to an activation box for maximally charging the phosphorescent material inside a glow-in-the-dark article. The activation box defines a chamber that allows light, either directly or indirectly by reflection, to completely surround the article. The interior walls of the box have a reflective or mirror-like surface for maximum light reflection. A transparent netting on the underside of the hinged lid holds or suspends the article on a transparent floor directly above a black lightbulb and free from contact with the sides of the chamber for maximum light absorption.

Figure 1:
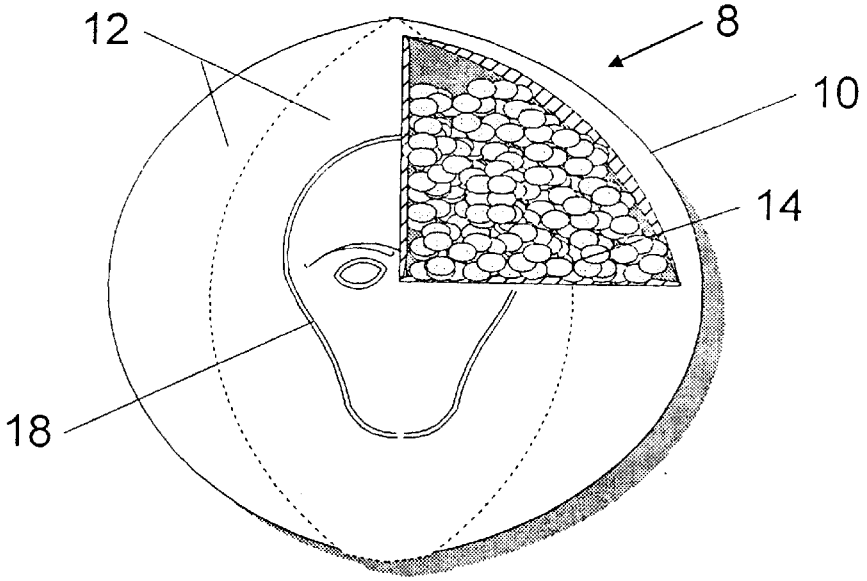
FIG. 1 is a schematic, partially cut-away, front view of a glow-in-the-dark article in accordance with the present invention.

FIG. 1 shows a glow-in-the-dark article in the form of a tossing ball 8 having pliant outer skin 10 which is made of a plurality of panels 12. Pliant skin 10 contains a semi-fluid phosphorescent material such as oblong particles or beads 14. Image 18 is affixed to skin 10. In contrast to pliant skin 10, image 18 blocks light transmission. Therefore, when internal particles 14 project phosphorescent light in the dark through skin 10, tossing ball 8 glows brightly, thereby highlighting image 18.

Skin 10 is preferably made of a stain-resistant, white woven fabric such as fine linen. The fabric is translucent or at least semi-translucent so that it blocks view of the phosphorescent filling material while allowing transmission of light from an external light source through the skin to the particles and back out of the skin in the form of phosphorescent light. In the embodiment shown in FIG. 1, ball 8 is approximately the size of a golf ball and is only partially filled, preferably about 80-percent, with particles 14 so that the general feel of ball 8 is similar to other known footbags. Panels 12 may be joined together in any suitable manner. Preferably, panels 12 are stitched together with code 3 size, 60–80 thread, and a double stitch is used for reinforcement.

Particles 14 may range in size from approximately 1 mm to 5 mm in diameter. The preferred composition for particles 14 is a mixture of low or high density polyethylene resin and 1-percent to 10-percent LumiNova® phosphorescent material from Nemoto & Co. Ltd., extruded through a water process to obtain an oblong or round-shaped rice pellet or bead. At the end of the process, the beads are rinsed and dried. LumiNova® material contains a metal (aluminum strontium) oxide phosphorescent powdered pigment for coloring plastics and inks, and other applications where a long glow and/or light fastness is desired. Details concerning the LumiNova® material are set forth in U.S. Pat. No. 5,424,006, the entirety of which is hereby incorporated by reference. Other phosphorescent pigments may be used such as inorganic sulfide phosphor resin (ZnS:Cu) at a 10-percent to 50-percent mixture with low or high density polyethylene resin. By mixing or impregnating the phosphorescent resin with or in the plastic carrier, a highly stable phosphorescing light source is constructed so that it is unnecessary to seal the particles in a special gas composition for stability purposes. It is therefore possible to use breathable skin materials such as woven fabric which works particularly well for the dual purposes of allowing light transmission while obfuscating view of the phosphorescent filling material.

Phosphorescent beads or particles 14 are light transmissive and oblong so that beads sitting inside a pile can receive and emit light even though they are covered by other beads. The purpose of making the beads oblong is to minimize the radius from center to surface for a given bead size, thereby improving light-charging and emitting efficiency. It is also preferable for the particles to be substantially transparent or translucent so that particles inside a pile may receive and emit light even though they are covered by other particles.

Light blocking image 18 may be embroidered or printed on outer skin 10 in any color and may include phosphorescent pigments. A thick black ink or thread works well for this purpose. Skin 10 may also be sprayed with pigments or dyes with or without glow-in-the-dark properties to create different interesting visual effects. It is also possible to mix colors into the particles changing the color of the phosphorescent glow while still permitting light transmission through the particles.

Figure 2A:
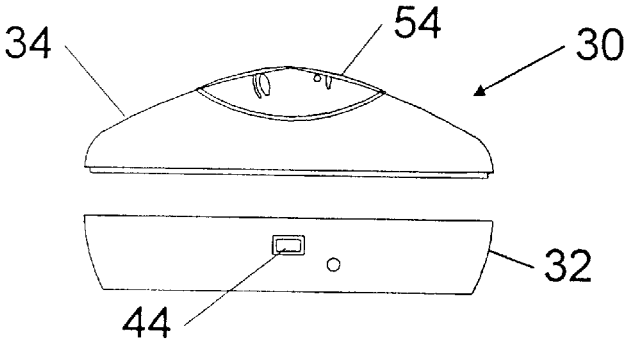
FIGS. 2A–C illustrate components of a case for carrying and charging a glow-in-the-dark article in accordance with the present invention.
Figure 2B:
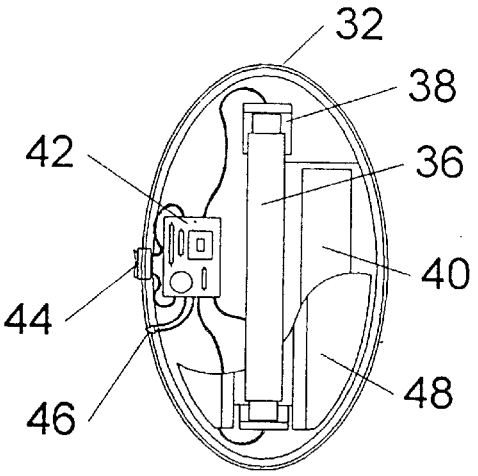
Figure 2C:
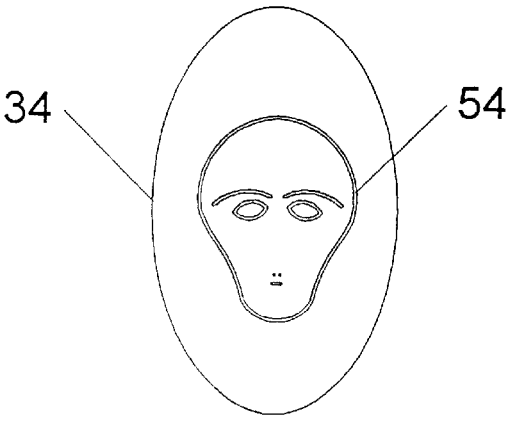

FIGS. 2A–2C illustrate another important aspect of the invention relating to a case for carrying and charging an article such as the one shown in FIG. 1 and described above. FIG. 2A shows charging case 30 which has two main components, bottom cavity 32, also referred to as main chamber portion, and cover 34, also referred to as lid or top. As shown in FIG. 2B, black light bulb 36 plugs into sockets 38. Batteries 40 are included to power the light source. Circuit board 42 controls electrical power function. On/off switch 44 is positioned on an external wall of bottom cavity 32. AC adapter post 46 is provided so that the device can be plugged into a conventional wall socket. Reflector 48 reflects light from bulb 36 toward a centrally located phosphorescent article for enhanced light charging efficiency. Reflector plate 48 also conceals batteries 40 and circuitry 42 from sight when viewing the open activation box. FIG. 2C shows a top view of lid 34 on which indicator light 54, in a form corresponding to image 18 on tossing ball 8, is shown. Indicator 54 lights up when black lightbulb 36 is turned on, giving an external indication that phosphorescent charging is ongoing.

Figure 3:
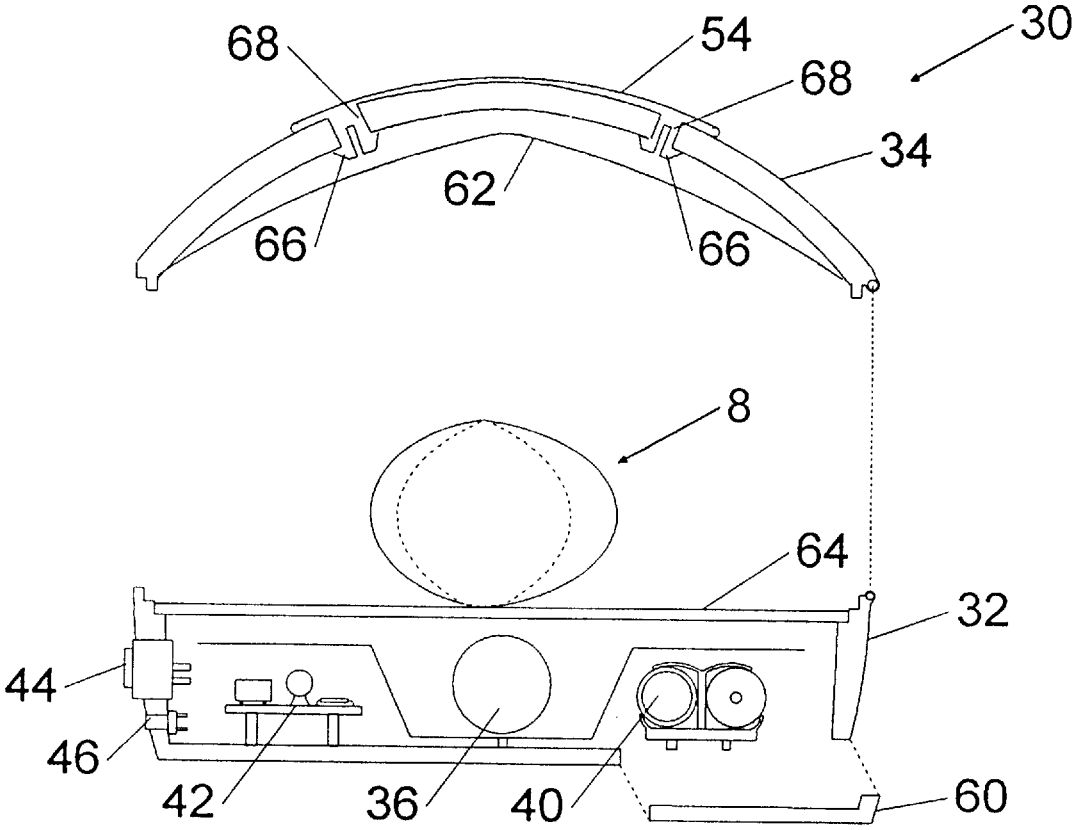
FIG. 3 is a schematic sectional view of the case shown in FIG. 2A.

FIG. 3 shows a different view of charging case 30. Most of the structures shown in FIG. 3 have already been discussed. Additionally, battery cover 60 provides external access to the battery compartment. Translucent or transparent net 62 on the internal side of lid 34 helps to hold phosphorescent article 8 in place when case 30 is closed. Another important component of the invention, shown for the first time in FIG. 3, is transparent floor 64 which supports phosphorescent article 8 directly above black lightbulb 36. Floor 64 and net 62 cooperatively hold article 8 in an optimal central position for charging the phosphorescent filling material.

Graphic indicator 54 in lid 34 is a separate piece of plastic with pegs 66 on the underside which are inserted into holes 68 in lid 34. Thus, when black light 36 is on, colored light is emitted from indicator 54. Indicator 54 may also contain phosphorescent material so that when black light 36 is off and case 30 is in the dark, indicator 54 glows in an image form which corresponds or somehow relates to images which are highlighted on articles inside the case.

The case, in a preferred embodiment, has a lid which is hinged to the main chamber portion and is dimensioned so that when it is closed the inner chamber is substantially light tight. When closed, the activation box is approximately 7 inches long by 4 inches high by 5 inches wide. The base and lid cavities are injection molded or thermoformed and are made from durable, high impact resistant plastic resin having a drop-weight impact resistance of ASTM D3029 standard. A variety of plastic resins may be used such as high density polyethylene, and may include up to 30-percent regrind or recycled material. The exterior of the base cavity and the lid are preferably the same color.

Figure 4:
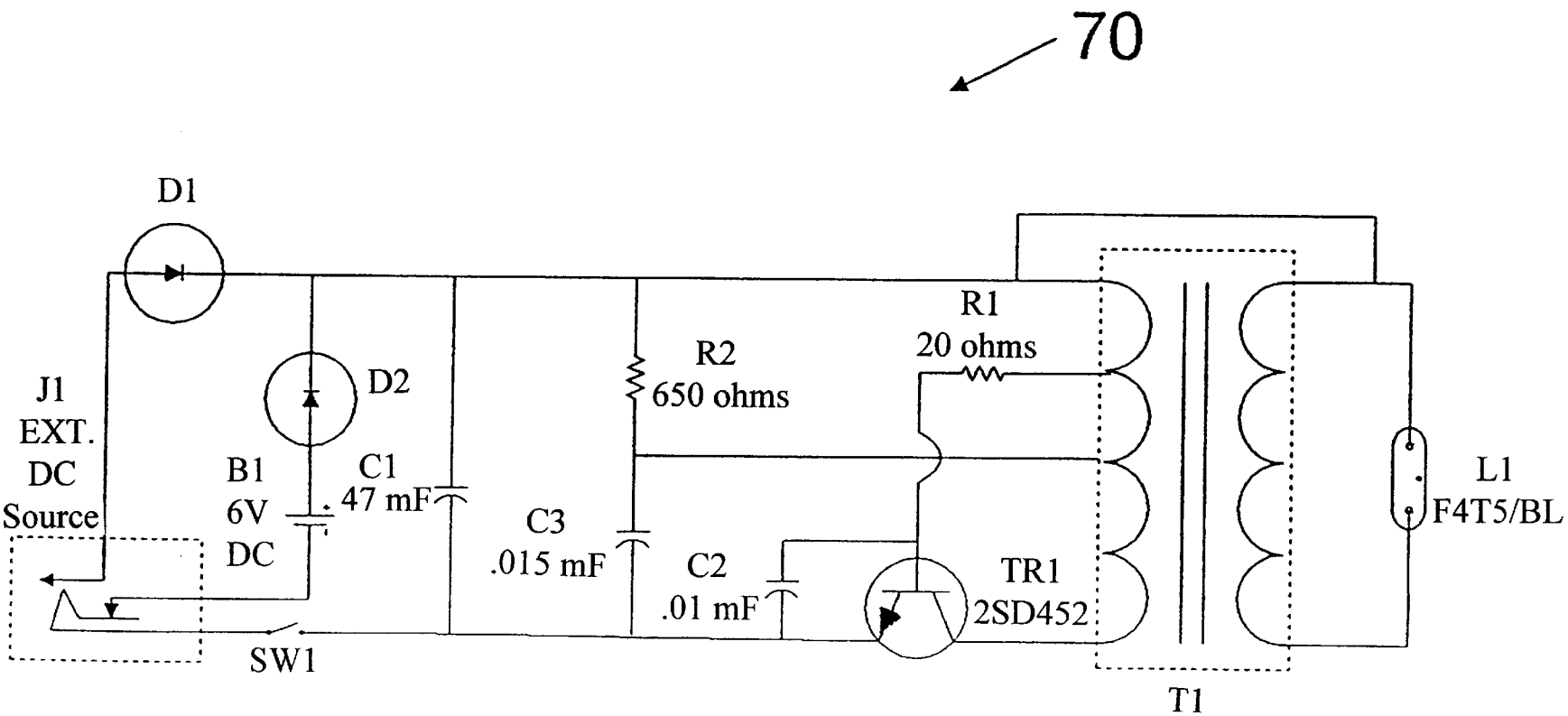
FIG. 4 is a schematic circuit diagram illustrating the electrical configuration employed to provide power to the light source in the charging case.

FIG. 4 shows circuitry 70 used on circuit board 42 to control electrical operation of charging case 30. Electronic circuit 70 is used to start and operate the gas discharge light source from 4 AA size batteries. The bulb can also be powered via AC adaptor post 46, by an external 6-volt DC source, for example, a car adaptor with plug designed to engage an outlet for a cigarette lighter.

The schematic circuit diagram 70 is electronically assembled so that when the on/off switch SW1 is in the on position the ground of the circuit 70 is switched to connect with the ground of the battery B1. This will cause diode D2 to allow current to flow to the rest of the circuit. When the current is flowing the transistor TR1 is biased "on" through the resisters R1 and R2 and the capacitors C2 and C3. Capacitor C1 holds the voltage constant. The transistor's TR1 "on" state allows current to flow through the primary windows of step-up transformer T1. The black light L1, connected to the secondary winding of step-up transformer T1, is light by the voltage induced through the step-up transformers T1. The external DC jack J1 is a normally closed switch as well as an external DC source connection. The external DC jack J1 is connected to the on/off switch SW1 on one side and to the battery B1 on the other. When the adapter is in, the battery B1 is disconnected from the rest of the circuit and the external DC source is supplying power to the circuit through diode D1. When the adapter is out the battery B1 is connected to the circuit supplying the power.

The tossing ball and charging case described above make possible a highly efficient light transfer and utilization technique. The features of the case including but not limited to the black light source, reflector, transparent floor, etc., combined with important elements of the tossing ball such as the light-transmissive skin containing transparent plastic beads impregnated with highly chargeable pigment, make it possible for the ball to glow brightly and uniformly for hours after charging the ball with light in the case for only several minutes. Many variations of the specific devices described above may be created employing the basic principals of the invention as claimed below.

We claim:

1. A glow-in-the-dark article comprising:

an enclosure having an outer skin made of a woven fabric, a semi-fluid phosphorescent light source contained within the enclosure, wherein the skin allows substantial light transmission while hiding the source from view, and a light blocking image on the skin which is highlighted by the source when glowing in the dark.

2. The article of claim 1 wherein the skin is pliable.

3. The article of claim 1 wherein the skin is breathable.

4. The article of claim 1 wherein the skin is substantially white.

5. The article of claim 1 wherein the image is substantially black.

6. The article of claim 1 wherein the filling material comprises particles.

7. The article of claim 6 wherein the particles are at least partially transparent or translucent.

8. The article of claim 6 wherein the particles comprise plastic impregnated with phosphorescent compounds.

9. The article of claim 8 wherein the plastic comprises a polyethylene resin.

10. The article of claim 6 wherein the particles comprise 10-percent to 50-percent (w/w) ZnS:Cu.

11. The article of claim 6 wherein the particles comprise 1-percent to 10-percent LumiNova®.

12. The article of claim 6 wherein the particles are light transmissive.

13. The article of claim 6 wherein the particles have an oblong shape.

14. A glow-in the-dark article comprising:

an enclosure having an outer skin comprised of substantially white woven fabric, and a semi-fluid phosphorescent light source contained within the enclosure, wherein the skin allows substantial light transmission while hiding the source from view.

15. The article of claim 14 wherein the light source includes a plurality of phosphorescent particles, at least some of the particles are light transmissive and are comprised of plastic impregnated with phosphorescent compounds.

16. A method of producing an entertaining, highly visible, image in the dark comprising the steps of:

affixing a substantially opaque image on a piece of substantially white fabric, the fabric having a front side and a back side, interposing the fabric between a semi-fluid phosphorescent light source facing the back side of the fabric and a charging light source facing the front side of the fabric, charging the phosphorescent light source by projecting light from the charging light source through the fabric, and highlighting the image which is viewable on the front side of the fabric by projecting light from the phosphorescent source through the fabric, wherein the fabric allows substantial light transmission while hiding the source from view.

* * * * *